United States Patent [19]

Myers

[11] Patent Number: 4,979,874

[45] Date of Patent: Dec. 25, 1990

[54] VARIABLE VAN DRIVE MECHANISM

[75] Inventor: Steven W. Myers, Lake Park, Fla.

[73] Assignee: United Technologies Corporation, Hartford, Conn.

[21] Appl. No.: 368,494

[22] Filed: Jun. 19, 1989

[51] Int. Cl.[5] ..... F01D 17/12

[52] U.S. Cl. ..... 415/160

[58] Field of Search ..... 415/151, 154.2, 159, 415/160; 403/383, 334, 258

[56] References Cited

U.S. PATENT DOCUMENTS

| | | | |
|---|---|---|---|
| 352,229 | 11/1986 | Crowell | 415/159 |
| 579,307 | 3/1897 | Skarin | 308/179.5 |
| 1,512,702 | 10/1924 | McCarty | 403/334 |
| 2,191,304 | 2/1940 | Ashendorf | 403/383 |
| 2,228,770 | 1/1941 | Le Tourneau | 287/53 |
| 2,746,713 | 5/1956 | Peyrin et al. | 415/160 |
| 2,930,579 | 3/1960 | Boyd et al. | 253/24 |
| 3,181,902 | 5/1965 | Aitken | 403/258 |
| 3,338,603 | 8/1967 | Sheppard | 287/52.08 |
| 3,990,809 | 11/1976 | Young et al. | 415/160 |
| 4,314,791 | 2/1982 | Weiler | 415/159 |
| 4,373,859 | 2/1983 | Thebert | 415/159 |
| 4,430,043 | 2/1984 | Knight et al. | 415/159 |
| 4,448,435 | 5/1984 | Hon | 280/278 |
| 4,741,665 | 5/1988 | Hanser | 415/150 |

FOREIGN PATENT DOCUMENTS

| | | | |
|---|---|---|---|
| 197803 | 3/1978 | United Kingdom | 415/151 |

*Primary Examiner*—Edward K. Look
*Assistant Examiner*—Hoang Nguyen

[57] ABSTRACT

Improvements to a mechanism for positioning variable vanes of a gas turbine are disclosed. Various construction details for introducing flexibility into the mechanism and for holding components in a snugly fitting relationship are discussed.

6 Claims, 2 Drawing Sheets

VARIABLE VAN DRIVE MECHANISM

This invention was made with Government support under a contract awarded by the Department of the Air Force. The Government has certain rights in this invention.

DESCRIPTION

1. Technical Field

This invention relates to gas turbine engines and particularly to apparatus for controlling the positions of variable vanes. The concepts were developed for use in controlling the positions of variable inlet guide vanes of such engines, but may be equally applicable to the control of variable vanes throughout the engine.

2. Background Art

Gas turbine engines of the type to which the concepts of the present invention apply have an axial flow compressor at the forward end thereof. Working medium gases entering the engine are compressed through alternating rows of rotating compressor blades and stationary compressor vanes, both of which are concentrically disposed about a common axis. At the entrance to the engine are disposed a first row of vanes called "inlet guide vanes". The function of the inlet guide vanes is to turn the air entering the compressor to an optimum angle of attack as the air approaches the first row of compressor blades.

Engines operate at varied power levels. Raising or lowering the power level by increasing or decreasing the fuel flow to the engine combustion chamber causes the compressor blades to rotate about the common axis at correspondingly higher or lower speeds. Increasing or decreasing the speed of rotation of the blades alters the angle of attack of the blades relative to the working medium gases approaching the blades. Variations in the angle of attack above or below an optimum design cause reduced aerodynamic efficiency in the compressor.

In some engines the inlet guide vanes are made variable so as to be capable of matching the direction of the working medium gases exiting the guide vanes to the approximate angle of attack of the first compressor blades and any rotor speed. Aerodynamically efficient operation results. One such construction of inlet guide vanes and corresponding linkage of the drive mechanism is shown schematically in FIG. 2 (Prior Art).

Notwithstanding the availability of such prior art drive mechanisms, scientists and engineers in the gas turbine engine field continually search for further improved constructions capable of ever increasing reliability and durability.

DISCLOSURE OF THE INVENTION

According to the present invention, the durability of a variable vane drive assembly is improved through the use of a flexible lever arm which engages the end of the corresponding vane at a tapered polyhedral socket.

The invention is predicated upon the recognition that wear in the drive assembly and lever arm as a result of loads transferred to the assembly from the variable vanes can be mitigated by increasing the flexibility of the drive assembly.

Primary features of the present invention include the flexible drive lever arm and tapered polyhedral socket at the point of engagement between the lever arm and the end of the variable vane. In at least one embodiment, a thin section at the mid-region of the drive lever arm provides the required flexibility. If at least one embodiment, the tapered polyhedral socket has a square, cross section geometry which provides indexing between the drive assemble the controlled vane.

A principle advantage of the present invention is reduced susceptibility to wear due to vibrations. The drive lever and the vane are held snugly together at the tapered engagement; vibratory motion is accommodated in the flexible drive arm rather the through slippage between the variable vane and the drive lever at the point of engagement.

These and other objects, features, advantages of the present invention will become more apparent in light of the detailed description of exemplary embodiments thereof as illustrated in the drawing.

BEST MODE FOR CARRYING OUT THE INVENTION

Figure 1:
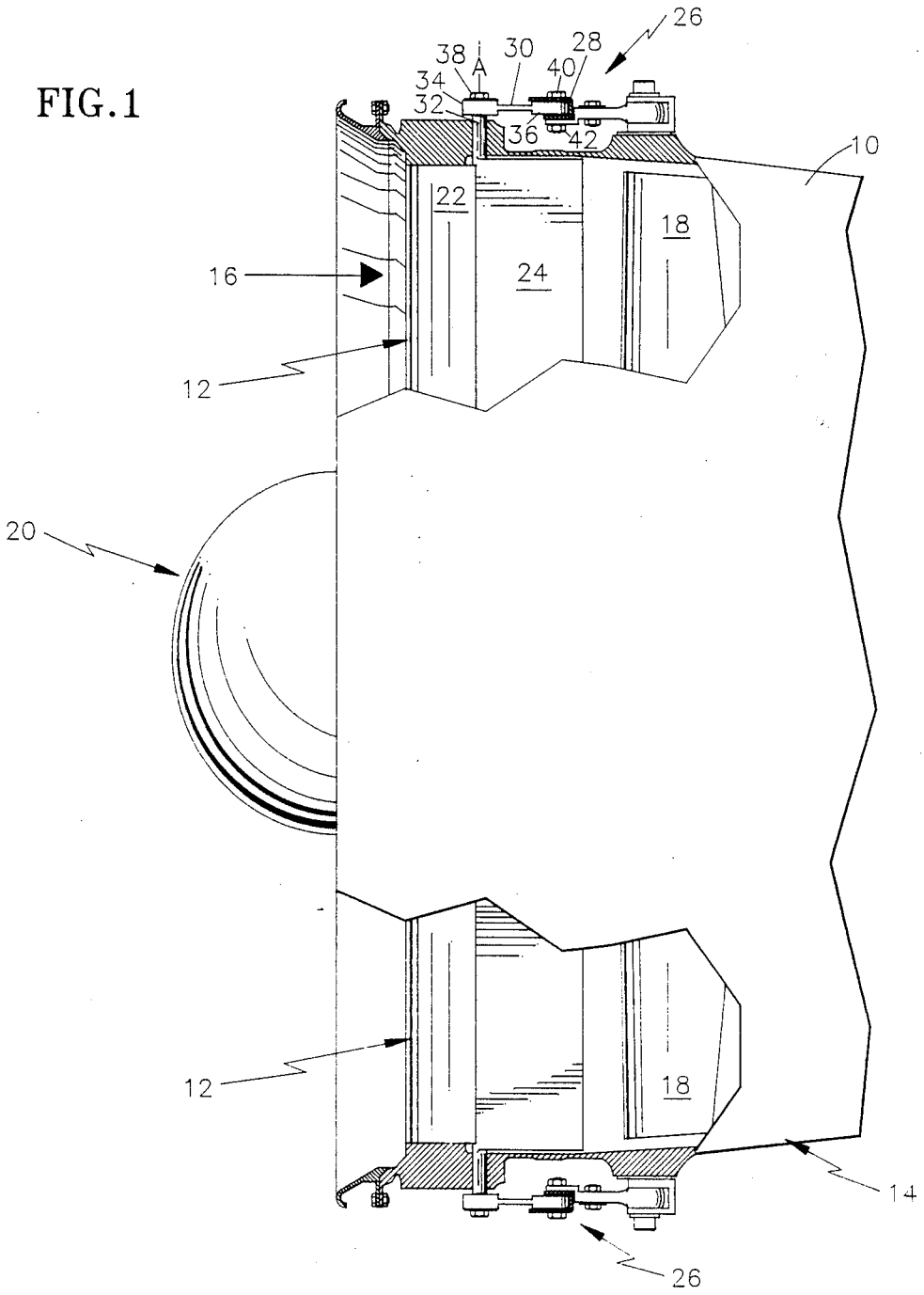
FIG. 1 is a simplified side view of the forward end of a gas turbine engine with a portion of the compressor casing broken away to reveal variable inlet guide vanes and the drive mechanism for positioning the vanes.
Figure 2:
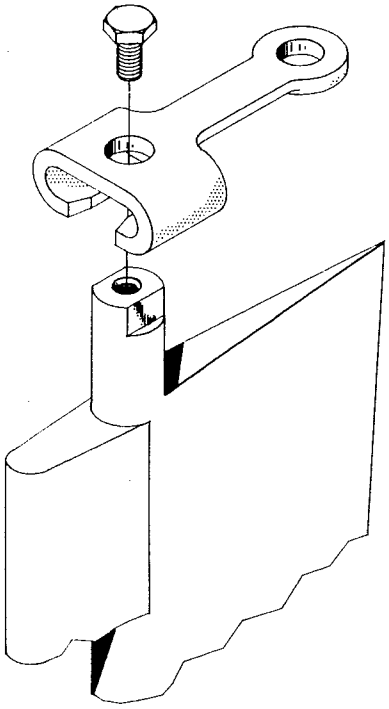
FIG. 2 PRIOR ART
FIG. 2 (Prior Art) is an exploded perspective view of a portion of the drive mechanism constructed in accordance with the prior art.

FIG. 1 is a simplified side view of a gas turbine engine with a portion of the compressor case 10 broken away to reveal a row of variable inlet guide vanes, as represented by the single vane 12. The variable inlet guide vanes are disposed inwardly from the engine stator 14 across the flowpath 16 for working medium gasses. A row of rotor blades, as represented by the single blade 18, extends outwardly from the engine rotor 20 across the flowpath for working medium gases immediately downstream of the variable inlet guide vanes.

Each variable inlet guide vane 12 has a leading edge segment 22 and a trailing edge segment 24. Each trailing edge segment is rotatable about an axis A to direct the working medium gases flowing thereacross to a preferred angle of discharge. The preferred angle of discharge varies with rotor speed such that the velocity vector of the working medium gases exiting the inlet guide vanes relative to the downstream rotor blades is in alignment with the angle of attack of the blades 18.

The trailing edge segments 24 of the inlet guide vanes 12 are rotatable synchronously by the drive mechanism 26. The drive mechanism principally includes a unison ring 28, a plurality of drive lever arms 30 extending one each from the unison ring to a single inlet guide vane, and means form rotating the unison ring circumferentially about the engine case 10. The means for rotating the unison ring may include any suitable actuator, such as a piston, electric motor, or the like, but is not specifically illustrated in the Drawing.

Figure 3:
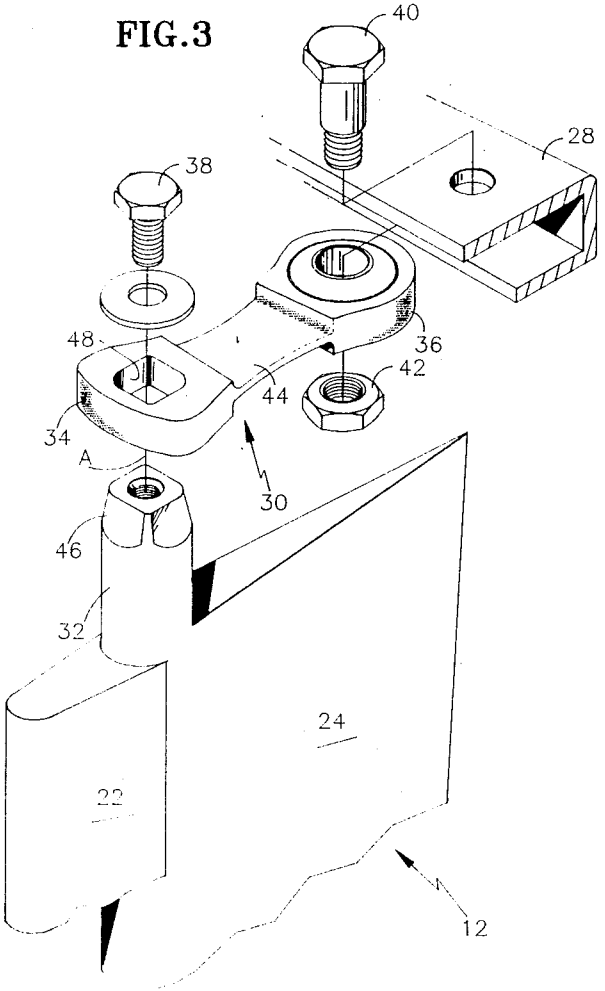
FIG. 3 is an exploded perspective view of the drive mechanism of the present invention.

As is shown in FIGS. 1 and 3, each drive arm lever 30 extends from the unison ring 28 to a post 32 at the outward end of a corresponding trailing edge segment 24. Each lever arm has a vane post end 34 and a unison ring end 36. The vane post end of each lever arm is attached to the corresponding vane post by clamping means, such as the bolt 38. The lever arm is fixedly attached to the vane post and is not rotatable thereabout. The unison ring end of each lever arm is attached to the unison ring by suitable means, such as the bolt 40 and the nut 42. The unison ring end of the lever arm is rotatable about the bolt 40. Between the vane post end and the unison ring end of the lever arm is a mid-region 44.

The drive lever arm 30 of the present invention is flexible in the mid region 44 between the vane post end 34 and the unison ring end 36. By way of illustration, in one embodiment having a drive lever arm fabricated of nickel alloy steel (AMS 5662 or AMS 5596), the length of the lever arm is approximately one and five tenths (1.5) inches between the center of the post end 34 and the center of the ring end 36; the minimum width is approximately three to four tenths (0.3–0.4) inches at the mid-region 44, and the thickness is on the order of five hundredths (0.05) of an inch.

The exploded view of FIG. 3 illustrates the point of attachment between the vane post 32 of the trailing edge segment 24 and the vane post end 34 of the drive lever arm 30. The lever arm and vane post are indexed together. The vane post end is a truncated polyhedral which in the specific embodiment illustrated has a square cross section region 46 which is tapered to smaller area cross sections in an outwardly direction. The vane post end of the drive lever arm has a receptacle 48 of a geometry corresponding to the geometry of the vane post end. In the embodiment thus far discussed the angle of the taper is on the order of six degrees (6°). The vane post end of the trailing edge segment is engaged by the lever arm and is held snugly affixed thereto by the bolt 38. Other cross section geometries and tapers may be suitable for other embodiments.

In operation of an engine incorporating the present invention, the variable inlet guide vanes 12 are rotated to the preferred position by the drive mechanism 26. The unison ring is repositioned circumferentially about the engine case causing the unison ring end 36 of each drive lever arm 30 to rotate about the corresponding bolt 40 and the vane post end 34 of the lever arm to rotate the trailing edge segment 24 of the corresponding inlet guide vane. The tapered mating surfaces of the vane post and of the drive lever arm are securely fastened under the clamping force of the bolt 38.

Making the lever arm 30 flexible reduces the loads imparted to the drive mechanism as a result of radial thermal deformations and vibratory motions between the vane post 32 and lever arm during engine operation and during vane actuation. Concomitantly, the clamping arrangement between the vane post 32 and the drive lever arm 30 reduces likelihood of slippage. The likelihood of slippage between the post and the arm is reduced and resultant wear is avoided.

Although the invention has been shown and described with respect to exemplary embodiments thereof it should be understood by those skilled in the art that the foregoing and various other changes, omissions and additions may be made therein and thereto without departing from the spirit and the scope of the invention.

I claim:

1. In an axial flow gas turbine engine of the type having variable inlet guide vanes operable by rotating a unison ring circumferentially about the engine case, the improvement which comprises:

a plurality of flexible drive lever arms extending from the unison ring, one each to a post at the radially outward end of a corresponding inlet guide vane; and means for attaching the drive lever arm to the post which includes a post end having a polyhedral geometry which is tapered to a smaller area cross section at the most outward end thereof, a receptacle on the drive lever arm of a geometry corresponding to the geometry of the post, and a bolt passing through the lever arm into the vane post for holding the lever arm and post in tight engagement to prevent wear under vibratory loading.

2. The invention according to claim 1 wherein the angle of taper of the polyhedral geometry of the post end is on the order of six (6) degrees.

3. The invention according to claim 1 wherein the polyhedral post end has a square cross section geometry.

4. The invention according to claim 1 wherein each of said drive lever arm as has a mid-region of sufficient cross-section geometry between the unison ring end and the vane port end to provide flexibility during operation.

5. The invention according to claim 4 wherein the mid-region of each of said drive lever arms is fabricated of nickel alloy steel and has a thickness on the order to five hundredths (0.05) of an inch.

6. The invention according to claim 5 wherein the length of each of said drive lever arms has a length on the order of one and five tenths (1.5) inches and a minimum width at the mid-region on the order of three to four tenths (0.3–0.4) of an inch.

* * * * *

UNITED STATES PATENT AND TRADEMARK OFFICE

CERTIFICATE OF CORRECTION

PATENT NO. : 4,979,874

DATED : December 25, 1990

INVENTOR(S) : Steven W. Myers

It is certified that error appears in the above-identified patent and that said Letters Patent is hereby corrected as shown below:

In the Title, and Column 1, line 2, "VAN" should read --VANE--

Col. 2, line 2, "If" should read --In--

Col. 2, line 5, "assemble" should read --assembly and--

Col. 2, line 10, delete "the", second occurance

Col. 2, line 55, "form" should read --for--

In the claims, claim #4, Col. 4, line 35, "lever arm as has" should read --lever arms has--

Claim #5, Col. 4, line 41, after "on the order" change "to" to --of--.

Signed and Sealed this

Twelfth Day of May, 1992

*Attest:*

DOUGLAS B. COMER

*Attesting Officer*

*Acting Commissioner of Patents and Trademarks*